United States Patent [19]

Fahrbach

[11] Patent Number: 4,725,009

[45] Date of Patent: Feb. 16, 1988

[54] TOROIDAL COIL WINDING MACHINE FOR TAPE OR HEAVY WIRE

[75] Inventor: Rudolf Fahrbach, Branchville, N.J.

[73] Assignee: Universal Manufacturing Co., Inc., Irvington, N.J.

[21] Appl. No.: 2,119

[22] Filed: Jan. 12, 1987

[51] Int. Cl.[4] ..... H01F 41/08

[52] U.S. Cl. ..... 242/4 B; 29/605; 29/729

[58] Field of Search ..... 242/4 B, 4 BE; 29/605, 29/729

[56] References Cited

U.S. PATENT DOCUMENTS 2,430,105 11/1947 Conklin ..... 242/4 B 3,732,901 5/1973 Kent et al. ..... 242/4 B 4,637,563 1/1987 Arie et al. ..... 242/4 B

FOREIGN PATENT DOCUMENTS 63782 8/1941 Norway ..... 242/4 B

*Primary Examiner*—Billy S. Taylor

*Attorney, Agent, or Firm*—Eliot S. Gerber; '

[57] ABSTRACT

In a toroidal coil winding machine to wind a tape or heavy wire on a toroidal core, the shuttle retains a length of wire or tape formed into a coil. A roller system is driven to support and maintain the inner diameter of the coil constant and the wire or tape is payed out from the inner diameter, to avoid stress on the wire or tape. An air motor independently drives a tension control roller which controls the pay-out tension without imparting undue stress to the wire or tape.

11 Claims, 28 Drawing Figures

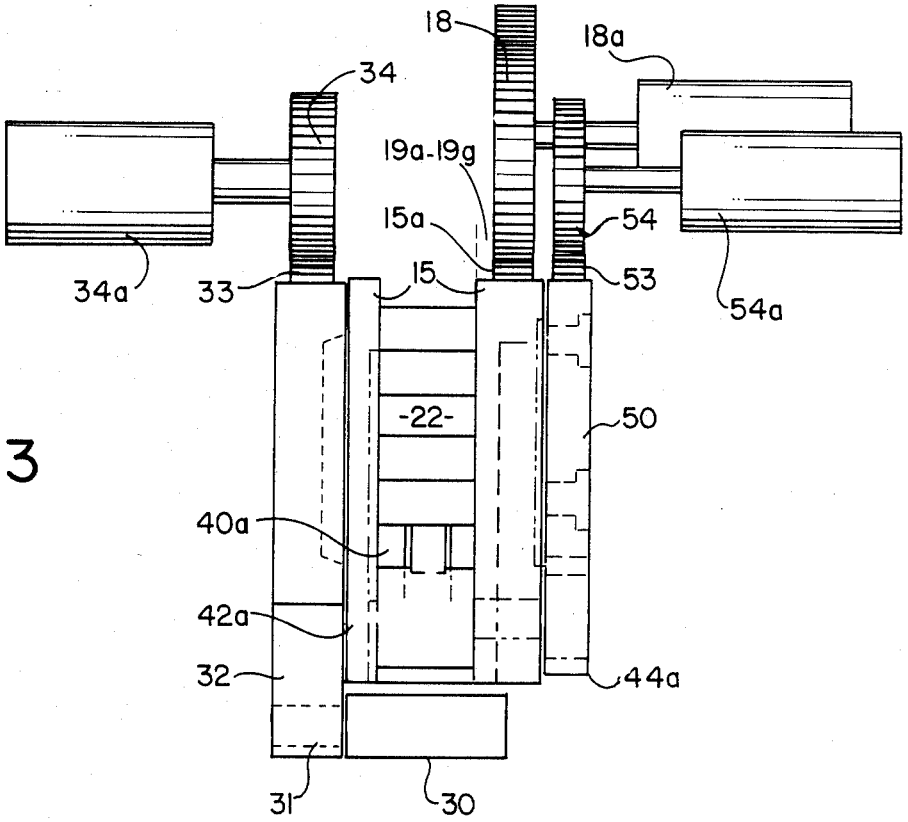
FIG. 3
FIG. 5A
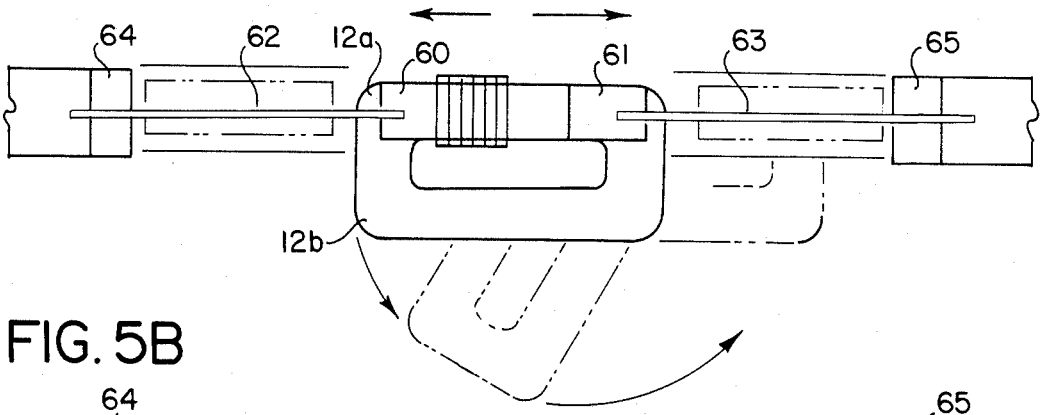
FIG. 5B
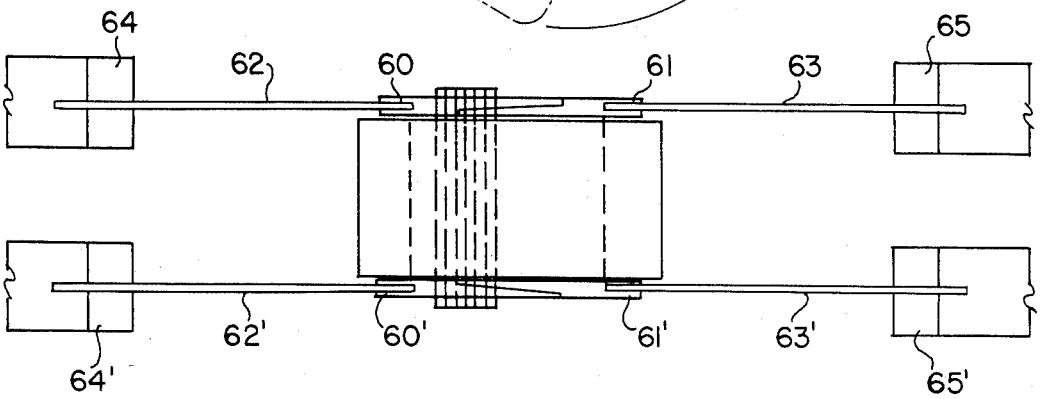

FIG. 3C
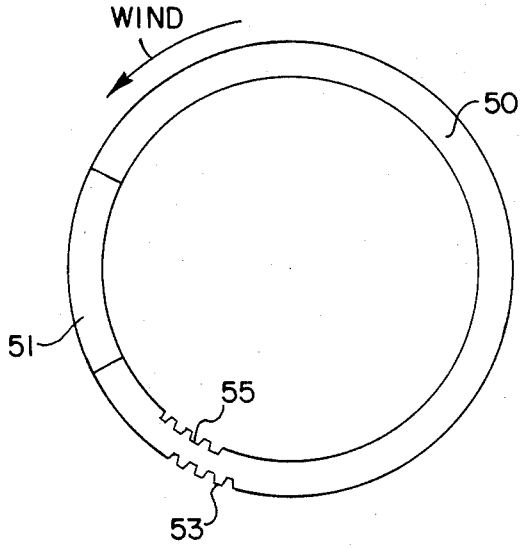
FIG. 3B
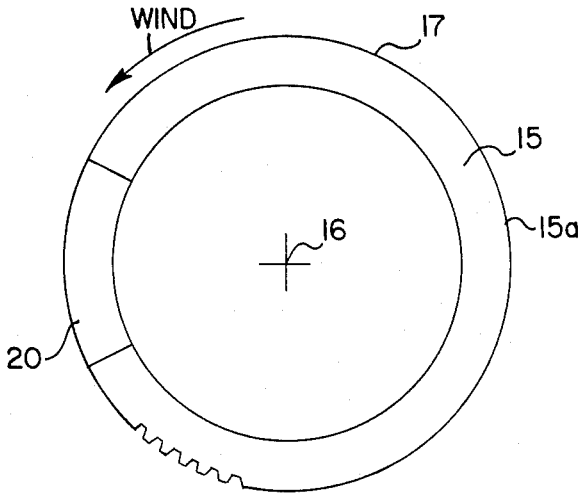
FIG. 6A
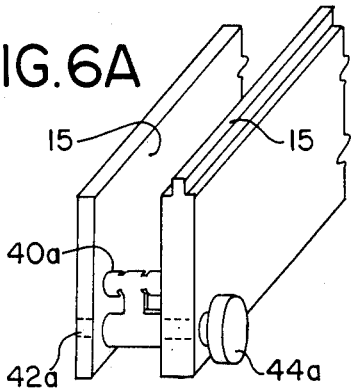
FIG. 3A
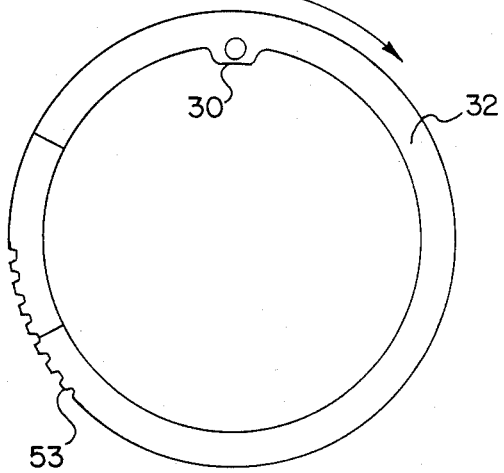
FIG. 4A
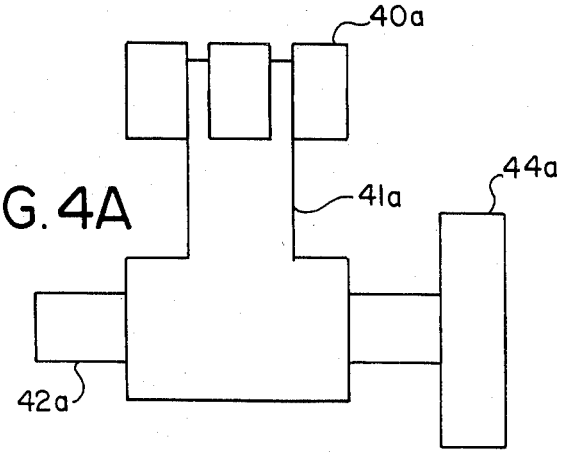
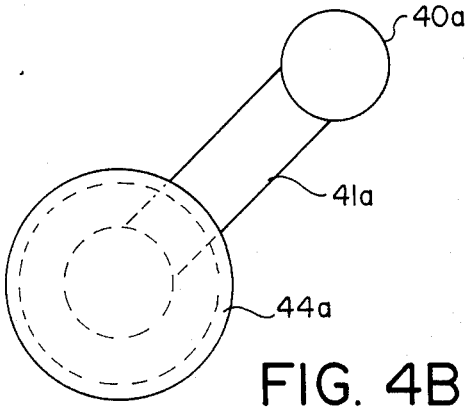
FIG. 4B

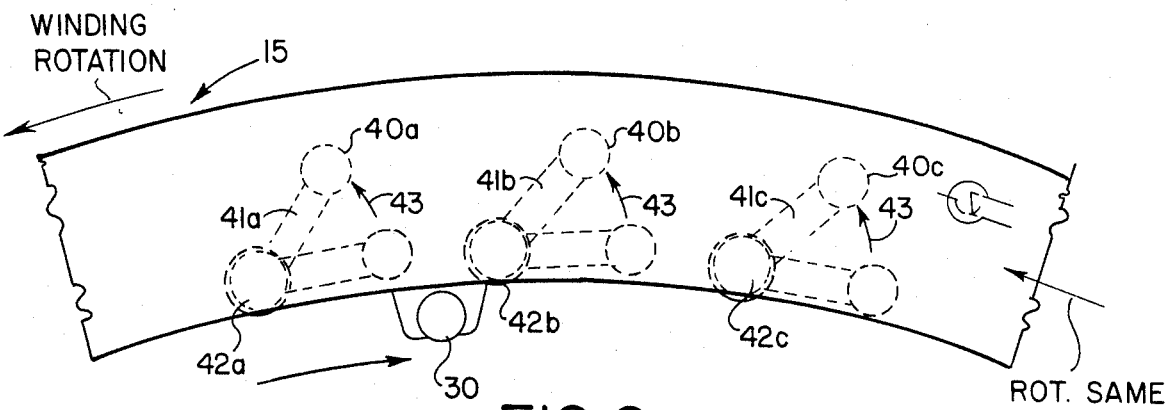
FIG. 6
FIG. 9
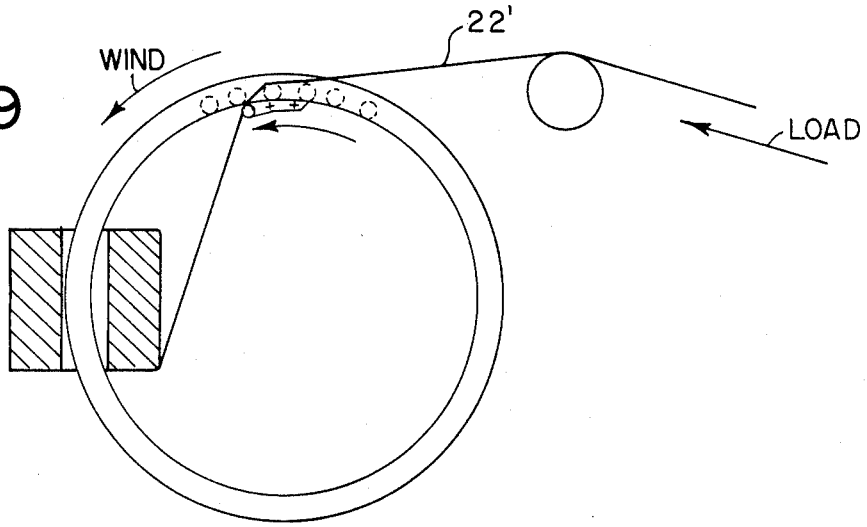
FIG. 5
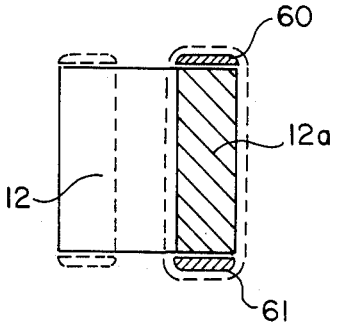

FIG. 10C
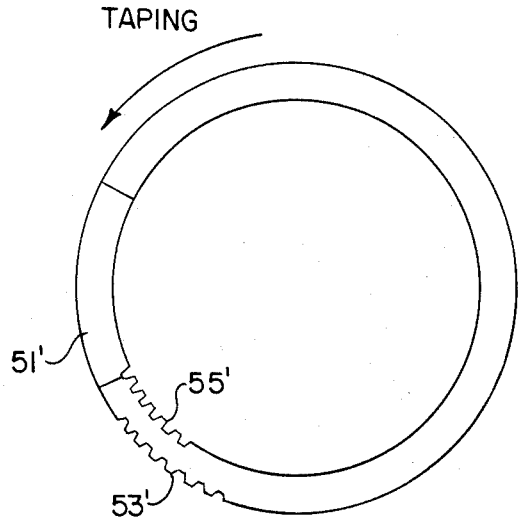
FIG. 10B
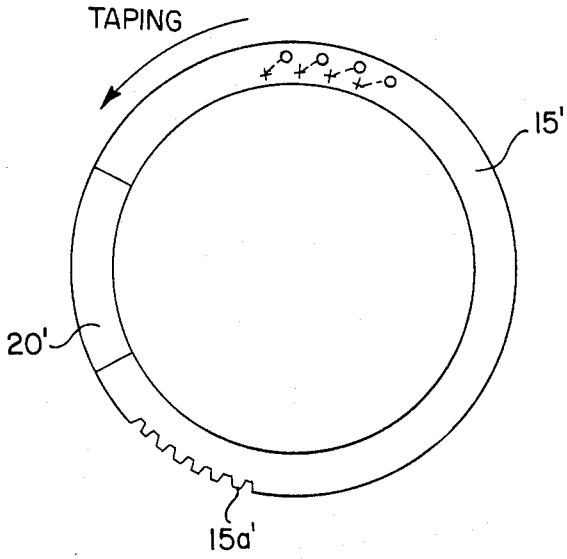
FIG. 10A
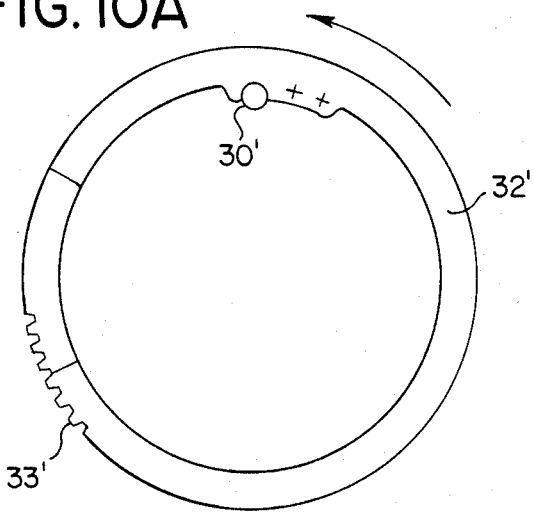
FIG. 14
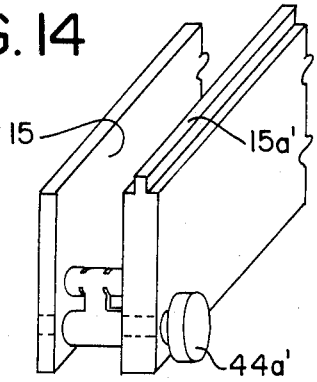
FIG. 13A
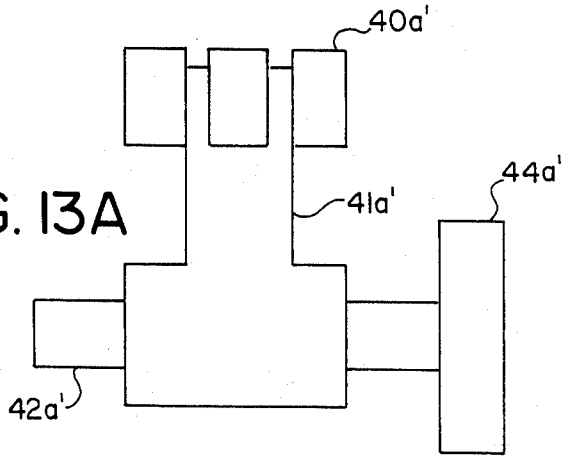
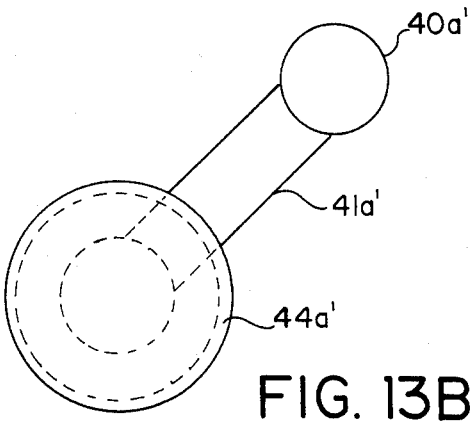
FIG. 13B

TOROIDAL COIL WINDING MACHINE FOR TAPE OR HEAVY WIRE

BACKGROUND OF THE INVENTION

The present invention relates to toroidal coil winding machines.

At the present time conventional coil winding machines for winding a toroidal core (bobbin) generally use a shuttle magazine mechanism ("shuttle") in the form of a ring having an opening which fits through the hole of the core. A supply of wire is loaded in the shuttle in the form of a coil and then, during winding, the shuttle pays out the wire and lays the wire on the bobbin. During loading and winding the shuttle is rotated so that it passes within the hole of the toroidal core.

In one type of coil winding machine, generally called a "precision coil winder", tension is maintained on the wire at all times so that the wire may be laid in an exact predetermined pattern, generally side-by-side, to form an evenly spaced coil. In conventional coil winding machines, the wire is transported from the shuttle to the core over a roller. The roller, which is relatively small, imposes a sharp curve on the wire as the wire passed over the roller. This has not been a problem because generally the wire is of a relatively small diameter and is sufficiently flexible so that it passes over the roller without imparting a permanent bend or adverse work hardening to the wire.

There are now new types of material which have improved electrical and magnetic characteristics for use in toroidal coils, one type being an amorphous (non-crystalline) metal.

It has been suggested that metals may be used in the form of tape to wind a core. However, if the tape is subjected to physical stress on the tape, the tape may be adversely affected in its magnetic properties. It has also been suggested that the new type of metal may be used as the core of a toroidal coil. Generally the metal cores are formed of thin sheets, which are electrically insulated from each other, to form a laminate. However, in some cases, such as an amorphous metal, the core presents an additional problem. It is relatively fragile in the sense that if physical stress is applied to the core, by tightly winding the wire about the leg of the core, the magnetic and electrical properties of the core are adversely affected. Consequently, the core should be wound as if it were an "air core", without imposing any physical stress to the core itself.

It has been suggested that a very heavy wire be used to form a coil in one leg of a transformer toroidal core. The wire is preferably rectangular in cross-section and, for example, is applied to form the primary winding of the transformer. In one embodiment the wire is formed in multiple layers.

In a conventional coil winding machine the wire is laid in the shuttle layer upon layer to form a circular coil of wire in the shuttle magazine. The wire is then removed from the top layer, i.e., from the outer diameter of the coil. In the case of a heavy wire or a tape, the removal from the top layer will impose a physical stress on the underneath layers, which stress may adversely affect the electrical and/or magnetic properties of the wire or tape.

OBJECTIVES AND FEATURES OF THE INVENTION

It is an objective of the present invention to provide a coil winding machine in which tape or heavy wire may be wound on a toroidal coil without imposing work hardening or other mechanical stress on the wire or tape.

It is a further objective of the present invention to provide such a coil winding machine that will wind heavy metal wire of soft metal on a toroidal core and which will not impose a work hardening of the wire as it is being wound on the core, but will prevent such work hardening by avoiding imposing a sharp angle or small circumference on the wire.

It is a still further objective of the present invention to provide such a coil winding machine in which the tape or wire is not physically stressed by removing the tape or wire from the outer layer of a pile of layers.

It is a feature of the present invention to provide a coil winding machine adapted to wind a wire or tape ("elongated conductor") about a toroidal core having a hole. For example, the wire may be a soft aluminum heavy wire which is rectangular in cross-section or a tape may be of metal. The coil winding machine includes a base and clamp means to removably hold a toroidal core.

A ring-like shuttle magazine is rotatably mounted on the base and passes through the toroidal core hole in the case of heavy wire. The shuttle magazine removably retains a length of the elongated conductor formed into a coil. The shuttle magazine is rotated by drive means in one direction to load the elongated conductor into the magazine. It is rotated in the opposite direction to unload the elongated conductor from the inner diameter of the shuttle magazine and wind it about the core. For example, in one type of drive system, the shuttle magazine has external ring gear teeth which mesh with the teeth of a motor-driven drive gear.

In the case of taping, the shuttle magazine removably retains a length of tape formed into a coil. The shuttle magazine is rotated by drive means in the direction of taping, to load the tape into the magazine. Loading and taping are simultaneous. In the taping operation, the tape is unloaded from the inner diameter of the shuttle magazine and wound about the core. For example, in one type of drive system, the shuttle magazine has external ring gear teeth which mesh with the teeth of a motor-driven drive gear.

A hold-up means supports the inner diameter of the elongated conductor coil in the shuttle magazine. The hold-up means moves outwardly (relative to the imaginary center of the shuttle magazine) as the elongated conductor is payed out. A pay-off tension control means is positioned adjacent the inner diameter of the conductor coil in the shuttle magazine to control the tension on the conductor.

It is a further feature of the invention that the hold-up means includes a plurality of shaft members whose ends are rotatably mounted on the shuttle magazine, an arm fixed to each shaft member at one end of the arm, a roller connected to each arm at the opposite end thereof, and pivot drive means which pivot each shaft as the conductor is payed out. The rollers are held in supportive contact with the inner diameter of the coil of conductor in the shuttle magazine.

It is a still further feature of the present invention that, in the case of heavy wire winding, the pay-off tension control means includes a ring parallel to the shuttle magazine, a motor means, preferably an air motor, to rotate the ring in the opposite direction as the shuttle magazine during winding but independently thereof, and a pay-off roller fixed to the ring and positioned to contact the conductor and apply tension thereto.

It is a still further feature of the present invention that, in the case of taping, the pay-off tension control means includes a ring parallel to the shuttle magazine, a motor means, preferably an air motor, to rotate the ring in the same direction as the shuttle magazine during winding but independently thereof, and a pay-off roller fixed to the ring, and positioned to contact the tape and apply tension thereto.

SUMMARY OF THE INVENTION

In accordance with the present invention, there is provided a coil winding machine in which a toroidal core (bobbin) is removably held in a chuck mechanism. Before the wire (the "elongated conductor") is wound about one of the legs of the core or alternatively the entire core, four blades are removably positioned over the leg of the core which is to be wound. These blades, preferably flat plate members, prevent the leg of the core from being touched by the wire being wound about that leg. The removable blades protect the core from physical stress that would be imparted to it if the wire were directly wound on the core. After the wire is completely wound on the leg of the core, the blades are removed, leaving a small gap which may be subsequently filled by a suitable plastic resin, such as an epoxy resin. The blade members are automatically positioned and withdrawn by an air cylinder mechanism.

The coil winding machine of the present invention utilizes a shuttle magazine which is a circular ring-like member driven by a gear ring which is the outer face, or secured to, the shuttle magazine. In a conventional shuttle the wire is wound in the shuttle in a number of turns and the wire is removed from the shuttle by pulling it off the top layer, imparting a considerable stress on the underlying layers. In the present invention the conductor (wire or tape) is removed from the inner layer as it lays in the shuttle magazine. This avoids the stress and distortion on the wire which would be caused by pulling it from the top layer.

In the conventional shuttle, as the wire is removed, the coil of wires (wire bundle) becomes smaller and its outer diameter is reduced, while its inner diameter remains the same. In contrast, in the coil winding machine of the present invention, as the wire is removed, the inner diameter becomes larger and the outer diameter remains the same.

In the conventional tape magazine, the tape is removed from the inside, but as tape is removed, the inside diameter of the tape bundle remains the same and the outside diameter of the bundle is reduced. Therefore, every layer of tape changes its diameter, causing friction and stress between the layers.

The tape or wire is supported in the shuttle magazine by a series of hold-up rollers. These hold-up rollers are progressively moved outwardly, in relationship to the imaginary center of the shuttle magazine, as the wire or tape is pulled from the shuttle magazine. The direction of movement of the wire or tape, since it is from the interior of the shuttle, may be controlled so as to have only a very slight angle in its change of direction as it is wound on the core. This slight angle will minimize work-hardening of the soft material of a heavy wire or tape and does not impose a stress on the conductor which would degrade its magnetic and/or electrical properties.

The tension on the conductor is controlled by a pay-off roller which is connected by an extension arm to a ring. The ring is driven by an air motor so that the tension roller rotates, in case of tape, in the same direction and, in case of heavy wire, in the opposite direction, at approximately the same speed as the shuttle magazine. However, the tension roller rides behind the shuttle ring, by a predetermined amount, and maintains a relatively constant tension on the conductor or insulation tape.

BRIEF DESCRIPTION OF THE DRAWINGS

Other objectives and features of the present invention will be apparent from the following detailed description taken in conjunction with the accompanying drawings.

In the drawings:

FIG. 3 is a side plan view illustrating a portion of the coil winding machine of the first embodiment;

FIGS. 3A–3C are perspective views of the shuttle support ring, the shuttle magazine and the gear ring, respectively;

FIGS. 4A and 4B are front and side views, respectively, of the hold-up mechanism;

FIG. 5 is a side view of a torodial core partly in section.

FIGS. 5A and 5B are top and side views, respectively illustrating the toroidal coil and support blades of the first embodiment;

FIG. 6 is an enlarged side view illustrating a portion of the hold-up mechanism of the first embodiment;

FIG. 6A is a perspective and cross-sectional view of a portion of the shuttle magazine;

FIG. 9 is a diagram illustrating the taping process used in the taping machine of the second embodiment, similar to FIG. 2;

FIGS. 10A–10C are respective views of the shuttle support ring, the shuttle magazine and the gear ring, respectively, similar to FIGS. 3A–3C;

FIGS. 13A and 13B are front and side views of a hold-up mechanism similar to FIG. 4; and FIG. 14 is a perspective and cross-sectional view of a portion of the shuttle magazine, similar to FIG. 6A.

DETAILED DESCRIPTION OF THE INVENTION

The coil winding machine of the present invention is described in connection with two embodiments. The first embodiment, illustrated in FIGS. 1 through 6, is adapted to wind a heavy wire. For example, the heavy wire may be aluminum wire having a rectangular cross-sectional shape and a size of ¼-inch by ½-inch. It is important that the heavy wire be wound on the toroidal coil without a sharp bend because such a bend will cause "work hardening" and stretching of the wire and will adversely affect its magnetic and/or electrical properties. In one specific embodiment, the heavy wire is of dead soft aluminum and is wound on a leg of a toroidal core bobbin which has a given length. It is wound in one or more layers to form the winding of a transformer, such as an electrical distribution transformer.

Figure 1:
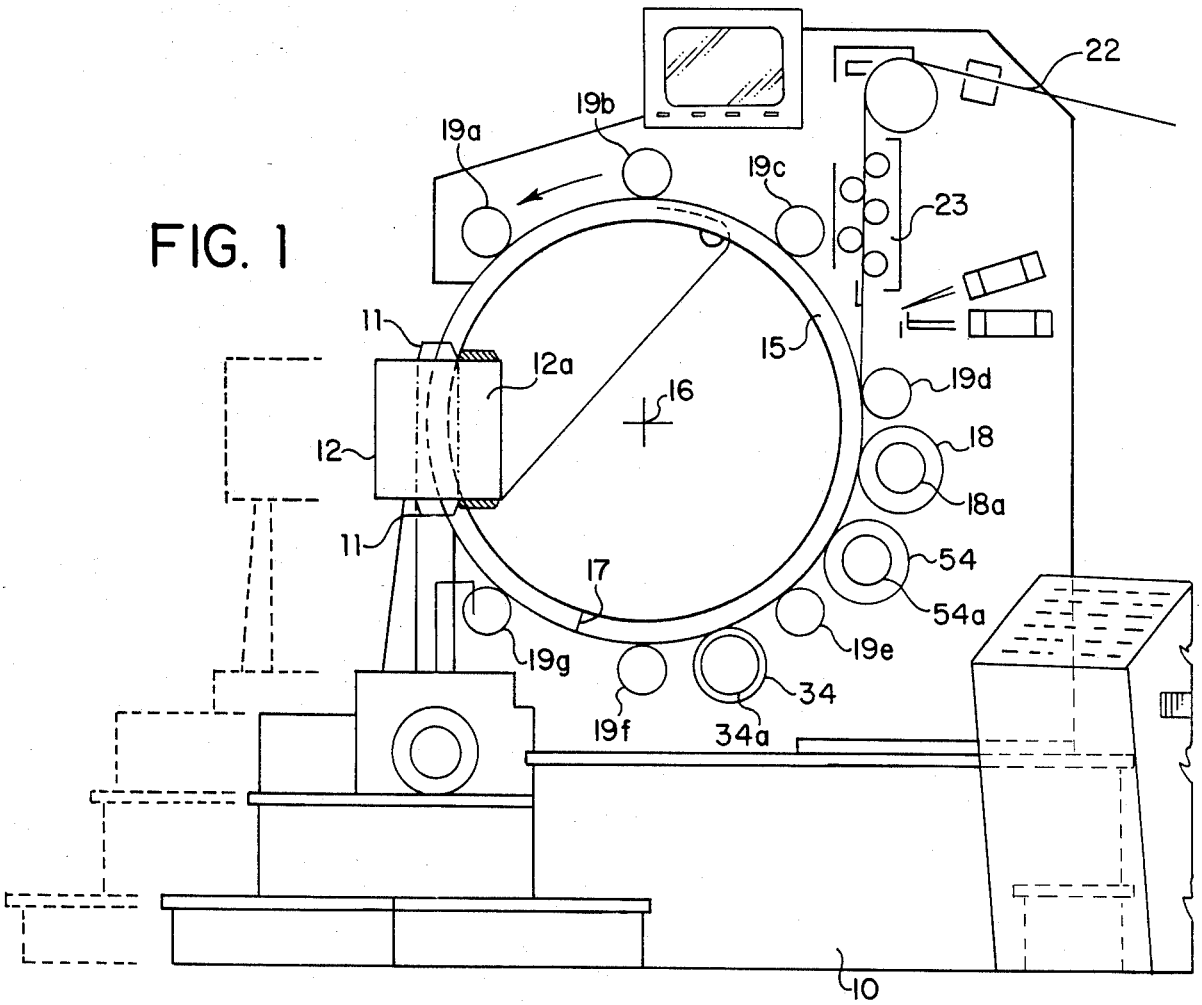
FIG. 1 is a side view of the first embodiment of the coil winder of the present invention, which first embodiment is adapted to wind a heavy wire.

As shown in FIG. 1, the coil winding machine of the first embodiment has a base 10. A support clamp 11 removably holds a toroidal core (toroidal core bobbin) 12. The core is automatically moved in and out of the position to be wound by the movement of the clamp 11 from its loading position, where the core is loaded onto the clamp, shown in dot-dash lines in FIG. 1 and FIG. 5, to its winding position, shown to the right of the dash-dot lines. The core 12 has a first leg **12*a* and opposite thereto a second leg 12*b*. In one example, the shuttle magazine 15 is loaded with as many wires as needed, for example, 6 turns of wire and the toroidal core leg 12*a* is wound with the selected number of turns of heavy wire to form part of the winding of a transformer. The shuttle magazine 15 is reloaded, the core 12 indexed, and the second leg 12*b*** is wound.

Figure 7:
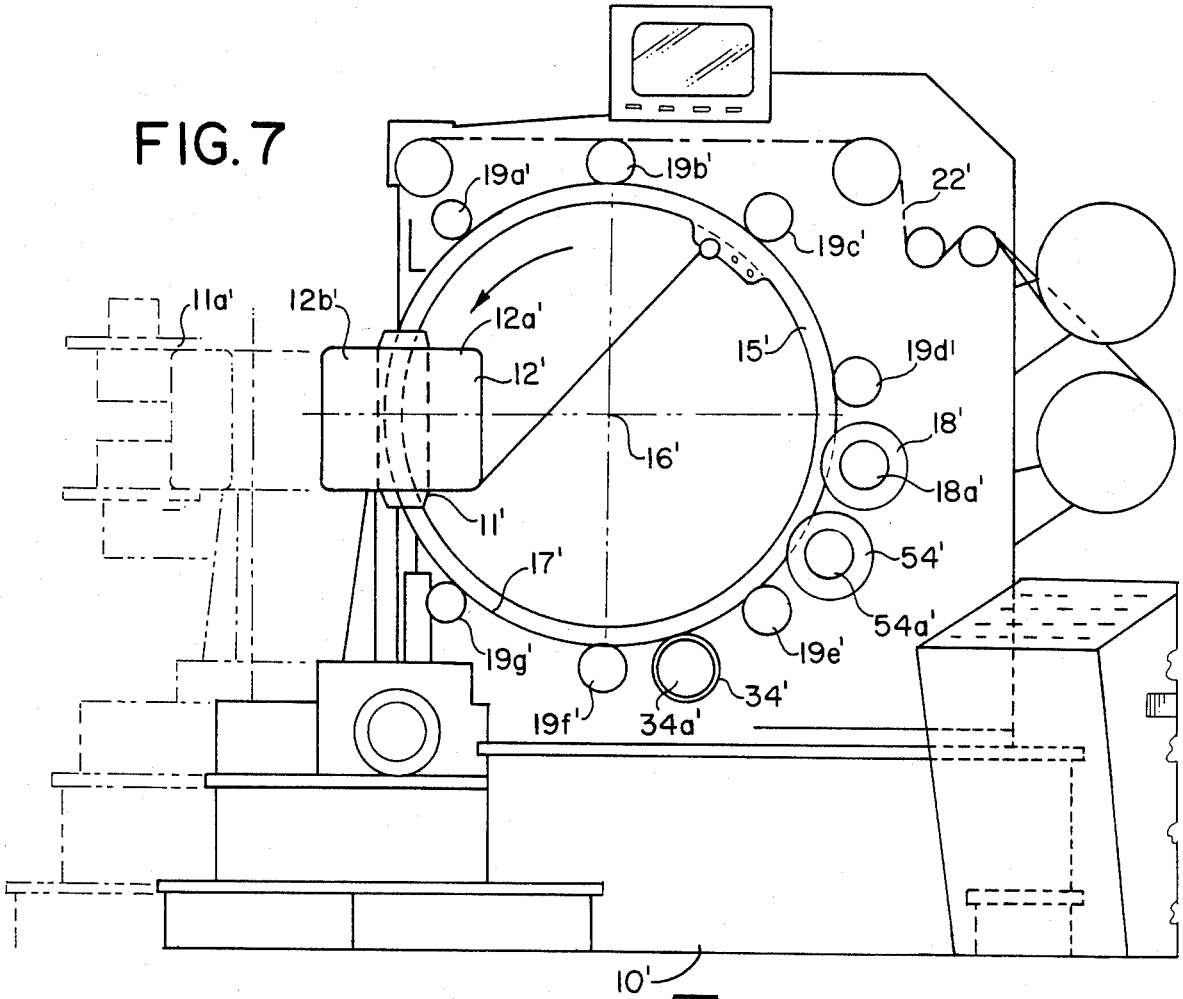
FIG. 7 is a side view of the second embodiment of tape winder of the present invention, which second embodiment is adapted to wind tape.
Figure 8:
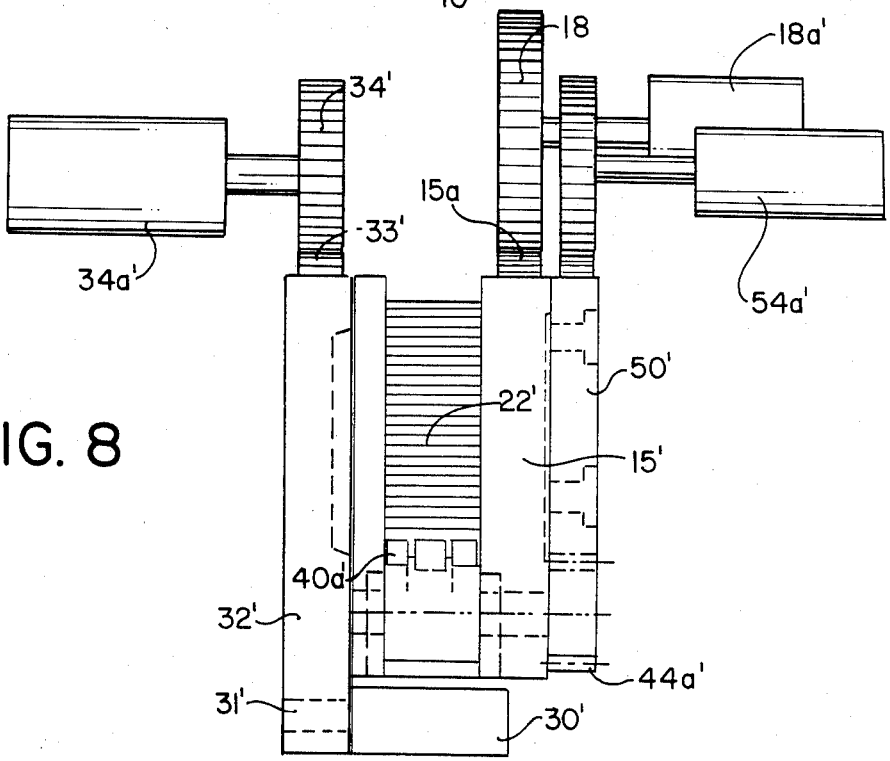
FIG. 8 is a side plan view, similar to FIG. 3, showing the shuttle mechanism of the second embodiment of the present invention adaopted to wind tape.
Figure 11A:
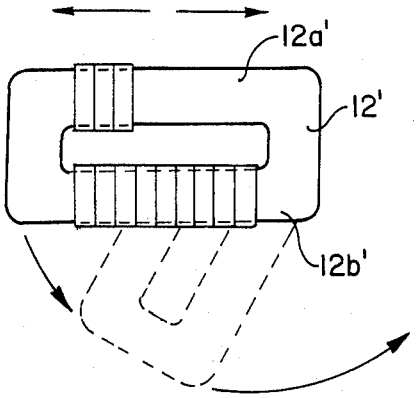
FIGS. 11A–11C are top, end and side views of a rectangular core.
Figure 11C:
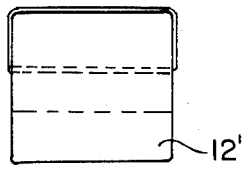
Figure 11B:
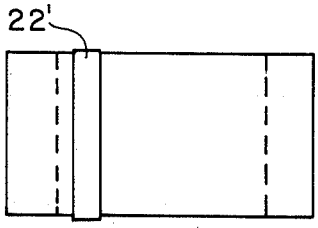
Figure 11D:
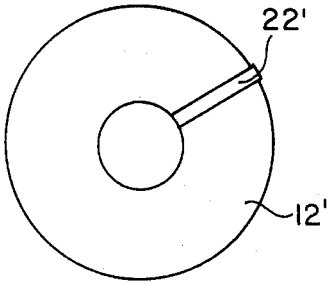
FIGS. 11D, 11E are top and side views of a toroidal core, illustrating the taping operation of the second embodiment, similar to FIG. 5.
Figure 11E:
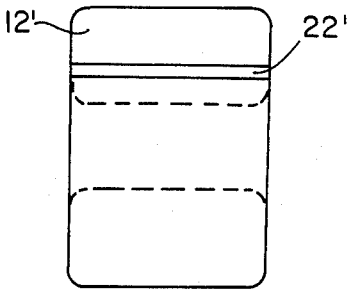
Figure 12:
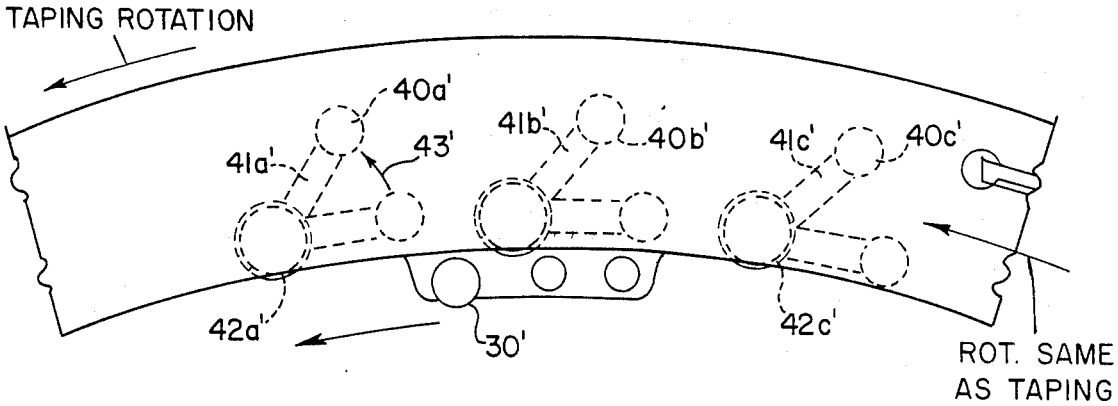
FIG. 12 is an enlarged side view, illustrating a portion of the hold-up mechanism of the second embodiment, similar to FIG. 6.

As shown in FIG. 7, the tape winding machine of the second embodiment has a base 10'. A support clamp 11', or a roller table **11*a*', removably holds a toroidal core (toroidal core bobbin) 12', see FIG. 11-1 to 11-3 and 11A–11B. The core is automatically moved in and out of the position to be wound by the movement of the clamp 11' or roller table 11*a*', from its loading position, where the core is loaded unto the clamp, shown in dot-dash lines in FIGS. 7 and 11, to its taping position, shown to the right of the dash-dot lines. The core 12' has a first leg 12*a*' and opposite thereto a second leg 12*b*'. In one example, the shuttle magazine 15 is loaded with tape 22'**, while the taping operation takes place. The tape is cut, when the required footage on the magazine is reached to tape the complete core, both legs in window winding or in a toroidal core.

The coil winding machine 1 has a shuttle magazine 15 which is in the general form of a ring-like member having a gap therein. For example, the shuttle magazine may be 50 inches in diameter taken from its imaginary center 16 to its outer dimension 17. The shuttle magazine 15 has external gear teeth **15*a* and is driven by drive gear 18 which mesh with the teeth 15*a*. The gear 18 is rotated by a first servo motor 18*a*. The shuttle magazine 15 is held in its circulatory clockwise and counterclockwise rotation path (as seen in FIG. 1) by a series of freely rotatable guide rollers 19*a* through 19*g*. For purposes of clarity, only seven guide rollers are shown, although more guide rollers may be utilized for a smooth progression of the shuttle magazine. The guide rollers 19*a*–19*g* and the drive gear 18 rotate the shuttle magazine in a circular path about its imaginary center 16**.

The shuttle magazine 15 may, optionally, have an insert 20, shown in FIG. 3B, which is removed before the magazine is loaded with a coil of wire. The shuttle magazine is placed through the opening, the insert 20 fixed in position to form a complete ring and then the shuttle is loaded with a length of wire sufficient to wind the leg **12*a* of the core 12. The shuttle magazine is now ready to wind the wire which has been loaded in the shuttle about the leg 12*a***.

Figure 2:
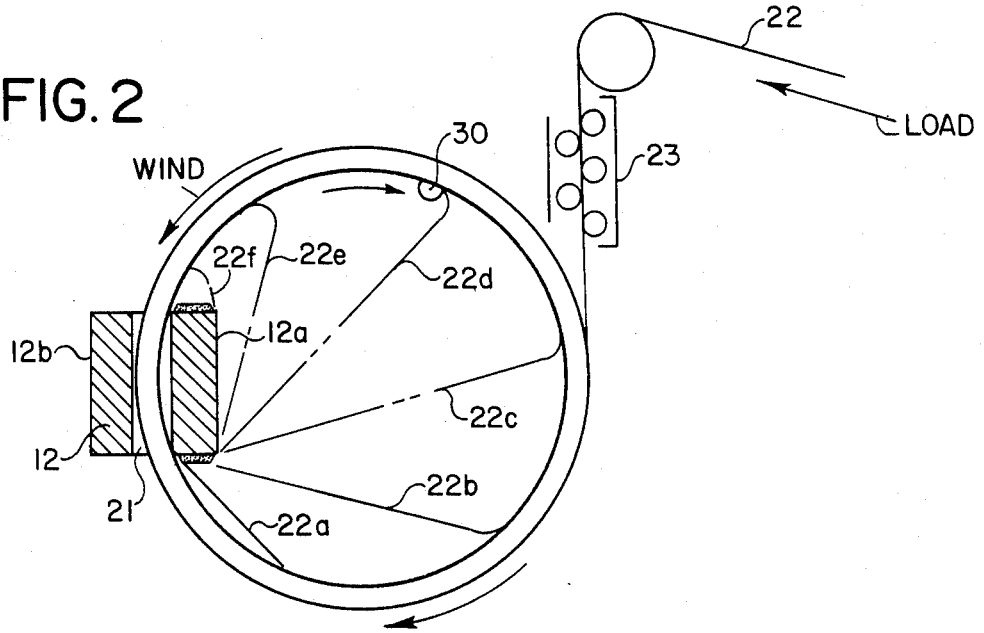
FIG. 2 is a diagram illustrating the winding process used in the coil winding machine of the first embodiment.

As shown in FIG. 2, the shuttle magazine is loaded by rotating it clockwise, as shown by the notation "Magload" in FIG. 2. For that purpose the heavy wire 22 is taken from its source, generally a spool of wire, and pulled through a wire straightener 23 consisting of a plurality of opposed freely rotatable and driven rollers. The wire 22 is then led into the shuttle magazine and loaded into a circular coil within the magazine.

After such loading has occurred, the shuttle magazine is rotated in the opposite direction, namely, in the counterclockwise direction, as shown by the notation "Wind" in FIG. 2. In the winding direction the wire is payed-off from the inside diameter of the shuttle magazine and carried around to wind the leg **12*a* of the core 12**. The magazine has a U-shape in cross-section, with the opening of the U facing its outer periphery, and openings facing its center.

FIG. 2 illustrates the wire 22, during winding, in four of its successive locations. In wire position **22*a* the wire is starting to come from the core center 21. In the wire position 22*b* the wire is laid along the bottom of the leg 12*a*. In the wire position 22*c* the wire is starting to be turned at the bottom outer corner of the leg 12*a*. At the wire position 22*e* the wire is almost in the perpendicular position and at the wire position 22*f* the wire has been laid along the outer side of the leg 12*a*** and is perpendicular.

As shown in FIGS. 2 and 3, the tension on the wire is controlled by a freely rotatable tension roller (pay-off) roller 30 which is rotatably connected at the end of the arm 31. The arm 31 is carried by a shuttle support ring 32 whose only function is to position the tension roller 30. The shuttle support ring 32 has external gear teeth 33 which mesh with the teeth of gear 34, which gear 34 is rotated by an air motor **34*g*. The air motor drives the tension roller 30 in the opposite rotary direction as the shuttle magazine, i.e., clockwise direction in the winding mode. The tension roller 30 maintains a predetermined amount of tension on the wire by changing the position of the tension roller relative to a point on the inner diameter of the shuttle 15. As shown in FIGS. 7 and 9, the tension on the tape is controlled by a freely rotatable tension roller 30', driven by an air motor 34*a*' by means of gear 34'. The air motor drives the tension roller 30'** in the same rotary direction as the shuttle magazine, in counterclockwise direction winding mode.

The hold-up means consists of a series of rollers which support the wire in the magazine 15 as it is payed-out. As shown in FIG. 6, a series of rollers are positioned and controlled to permit the wire to be payed-off from the internal diameter of the shuttle and yet retains the wire in a circular coil within the shuttle magazine 15. There may be preferably 40–60 such rollers, **40*a*–40*n*, and their associated lever arms and shafts, although only three are illustrated in FIG. 6 for purposes of simplicity of illustration. The three rollers 40*a*–40*c*, shown in FIG. 6**, are freely rotatable rollers which are rotatably mounted at the end of lever arms 41a–41c. The lever arms 41a–41c are fixed to the pivotable shafts 42a–42c.

In operation, during winding, the shaft 42a is showly pivoted in the direction shown by the arrow 43 as the wire is payed-out from the inner diameter of the shuttle magazine 15. As the wire is payed-out there are fewer and fewer layers of the wire and the hold-up rollers 40a–40c are simultaneously and positively pivoted in the counterclockwise direction from their full line position to the dotted line position, as shown in FIG. 6. In other words, the freely rotatable rollers 40a–40n, attached at the end of the arms 41a–41n, move outwardly in respect to the imaginary center 16 and hold-up the coil of wire as it is payed-off the shuttle magazine 15. Each of the hold-up roller lever arms and hold-up roller shafts operate in the same manner as the shaft 42a lever arm 41 and roller 40a. As the wire is payed-off from the shuttle magazine 15 to the core, the coil of wire rotates as required by the wire wound unto the core, within the magazine in the opposite direction as winding, held up and supported by the rotating rollers 40a–40n.

The shaft 42a, shown in FIG. 4A, has a gear 44a fixed thereto at one of its ends. The shaft 42a is freely pivotable in the two sides of the U of the shuttle magazine 15, see FIGS. 6A, 4A and 4B.

The gears 44a–44n are rotated by the internal gear teeth 55 of a gear ring 50 having optional removable insert 51, see FIG. 3C. The gear ring 50 is rotatably mounted relative to shuttle magazine 15 so that there may be relative rotation between the shuttle magazine 15 and the gear ring 50. The gear ring 50 has external gear teeth 53 which mesh with the teeth of drive gear 54, see FIG. 3. The drive gear 54 is independently driven by a second servo motor 54a which is independent of the first servo motor, in order to gradually rotate the gears 44a–44n as the wire is payed-out to thereby maintain the rollers 40a–40n in contact with the inner diameter of the coil of wire which lies in the shuttle magazine 15. The servo motor rotates the gear ring 50 at almost the same speed, and in the same direction, as the rotation of the shuttle magazine 15, except it rotates drive gear 54 slightly faster to advance the gear ring 50 a few teeth, relative to shuttle magazine 15, during each rotation of the shuttle magazine.

Before the wire is wound on the toroidal core for window winding, the top of the core, and optionally the bottom of the core, is protected by retractable support blades 60,61, 60',61', see FIGS. 5A and 5B. The blades have the same shape and size as the top and bottom of the leg of the core, and the blades provide a hole therethrough through which the shuttle is rotated. The blades 60,61,60',61' are connected at the ends of arms 62,63,62',63', respectively, which are connected to the pistons of the respective air cylinders 64,65,64',65'. After the core is wound the blades 60,61,60',61' are automatically retracted, by operation of the air cylinders 64,65,64',65' leaving a gap between the wire and the core which may be filled with a suitable filler, such as an epoxy plastic resin.

In operation, the unwound core is automatically moved into position and held there by the clamp mechanism. The air cylinders 64,64 and 64',65' are operated and bring the blades 60,61, and 60',61' over and under the core. Then the shuttle magazine 15, along with the rings 32 and 50, are rotated through the core hole and the wire is loaded into the shuttle magazine. After loading, the heavy wire may be held down by a light spot-weld, the direction of rotation of the shuttle magazine and the two rings is reversed and the wire is wound about the core. After the first coil is wound on leg 12a of the core 12, the support blades are withdrawn, the core feed will transfer the core to the start position, and index the core in (C.C.W.) counterclockwise rotary motion, to bring the leg 12b into winding position, see FIG. 5A. The loading operation is repeated, the support blades go into position, and the second coil upon the second leg 12b is wound. After the core is wound the blades are withdrawn, the shuttle is rotated so that its gap is at the core, and the core is rotated out of the way and removed from the clamp.

As shown in FIGS. 7–14, the second embodiment is similiar, in some respects, to the first embodiment and the corresponding part numbers carry corresponding numbers with a "prime" mark.

What is claimed is:

1. A coil winding machine adapted to wind an elongated conductor about a toroidal core having a hole therethrough, the coil winding machine including a base, and mounted thereon:

clamp means to removably hold a toroidal core;

shuttle means rotatably mounted on said base and including a ring-like shuttle magazine which passes through said toroidal core hole, said shuttle magazine removably retaining therein a length of the elongated conductor formed in a coil;

drive means to rotate said shuttle magazine in one direction to load said elongated conductor into said shuttle magazine and in the opposite direction during winding to unload said elongated conductor from the inner diameter of said shuttle magazine and wind said elongated conductor through said core hole and about said core;

a hold-up means to support the inner diameter of the elongated conductor coil in the shuttle magazine and, during winding, to move outwardly relative to the imaginary center of the shuttle magazine; and a pay-off tension control means positioned adjacent the inner diameter of said conductor coil in the shuttle magazine to control the tension on the conductor as it is being wound on the core.

2. A coil winding machine as in claim 1 wherein said elongated conductor is a wire.

3. A coil winding machine as in claim 2 wherein said wire is a flat ribbon.

4. A coil winding machine as in claim 2 wherein said wire is rectangular in cross-section.

5. A coil winding machine as in claim 1 wherein said elongated conductor is a tape.

6. A coil winding machine as in claim 5 wherein said tape is of metal.

7. A coil winding machine as in claim 1 wherein said hold-up means includes a plurality of shaft members, an arm fixed to each shaft member at one end of the arm, a roller connected to each arm at the opposite end, and pivot drive means to pivot each shaft as the conductor is payed out and to thereby maintain the rollers in supportive contact with the inner diameter of the coil of conductor in the ring shuttle.

8. A coil winding machine as in claim 1 wherein said pay-off tension control means includes a support ring parallel to said shuttle magazine, motor means to rotate the support ring as the shuttle magazine and rotatable relative thereto during winding and a pay-off roller fixed to the support ring and positioned to contact the conductor during winding and apply tension thereto.

9. A coil winding machine as in claim 8 wherein said support ring motor means is an air motor.

10. A coil winding machine adapted to wind an elongated soft metal wire about a toroidal core having a hole therethrough, the coil winding machine including a base, and mounted thereon:

clamp means to removably hold a toroidal core;

shuttle means rotatably mounted on said base and including a ring-like shuttle magazine which passes through said toroidal core hole, said shuttle magazine removably retaining therein a length of the wire formed in a coil and having an exterior gear face;

drive means to mesh with said gear face and rotate said shuttle magazine in one direction to load said wire into said shuttle magazine and, in the opposite direction, to unload said wire from the inner diameter of said shuttle magazine and wind said wire through said core hole and about said core;

a hold-up means to support the inner diameter of the wire coil in the shuttle magazine and to move outwardly relative to the imaginary center of the shuttle magazine as the wire is payed out of the shuttle magazine;

said hold-up means including a plurality of shaft members, an arm fixed to each shaft member at one end of the arm, a roller connected to each arm at the opposite end thereof, and pivot drive means to pivot each shaft as the wire is payed out to thereby maintain the rollers in supportive contact with the inner diameter of the wire coil in the shuttle magazine; and a pay-off tension control means positioned adjacent the inner diameter of said wire coil in the shuttle magazine to control the tension on the wire as it is being wound on the core, which control means rotates in the opposite direction as the shuttle magazine during winding and independently of the shuttle magazine.

11. A coil winding machine adapted to wind an elongated metal tape about a toroidal core having a hole therethrough, the coil winding machine including a base, and mounted thereon:

clamp means to removably hold a toroidal core;

shuttle means rotatably mounted on said base and including a ring-like shuttle magazine which passes through said toroidal core hole, said shuttle magazine removably retaining therein a length of the tape formed in a coil and having an exterior gear face;

drive means to mesh with said gear face and rotate said shuttle magazine in one direction to load said tape into said shuttle magazine and, in the same direction, to unload said wire from the inner diameter of said shuttle magazine and wind said wire through said core hole and about said core; wherein said shuttle magazine rotates and loads said tape into said shuttle magazine and rotates in the same direction when winding, to unload said tape from the inner diameter of said shuttle magazine and wind said tape through said core hole and about said core;

a hold-up means to support the inner diameter of the tape coil in the shuttle magazine and to move outwardly relative to the imaginary center of the shuttle magazine as the wire is payed out of the shuttle magazine;

said hold-up means including a plurality of shaft members, an arm fixed to each shaft member at one end of the arm, a roller connected to each arm at the opposite end thereof, and pivot drive means to pivot each shaft as the tape is payed out to thereby maintain the rollers in supportive contact with the inner diameter of the tape coil in the shuttle magazine; and a pay-off tension control means positioned adjacent the inner diameter of said tape coil in the shuttle magazine to control the tension on the tape as it is being wound on the core, which control means rotates in the same direction as the shuttle magazine during taping and independently of the shuttle magazine.

* * * * *